United States Patent [19]

Linden

[11] 4,033,582

[45] July 5, 1977

[54] METHOD OF STRINGING RACKETS

[76] Inventor: Gaylord C. Linden, 7583 El Arco, Cucamonga, Calif. 91730

[22] Filed: June 16, 1975

[21] Appl. No.: 587,141

Related U.S. Application Data

[63] Continuation of Ser. No. 446,780, Feb. 28, 1974, abandoned.

[52] U.S. Cl. ..... 273/73 D

[51] Int. Cl.[2] ..... A63B 51/00

[58] Field of Search ..... 273/73 R, 73 A, 73 C, 273/73 D, 73 E, 73 H

[56] References Cited

UNITED STATES PATENTS

| | | | |
|---|---|---|---|
| 1,132,214 | 3/1915 | Ries et al. | 273/73 D |
| 1,173,712 | 2/1916 | Du Bois | 273/73 D |
| 1,409,621 | 3/1922 | Tournier | 273/73 D |
| 1,687,848 | 10/1928 | Robinson et al. | 273/73 D |
| 1,980,783 | 11/1934 | Cook et al. | 273/73 D |
| 3,545,756 | 12/1970 | Nash | 273/73 D |
| 3,548,484 | 12/1970 | Carlton | 273/73 D |

FOREIGN PATENTS OR APPLICATIONS

| | | | |
|---|---|---|---|
| 976,198 | 10/1950 | France | 273/73 D |
| 1,444,292 | 5/1966 | France | 273/73 D |
| 5,177 | 4/1885 | United Kingdom | 273/73 D |
| 409,924 | 5/1934 | United Kingdom | 273/73 D |
| 566,130 | 12/1944 | United Kingdom | 273/73 D |

*Primary Examiner*—Richard J. Apley
*Attorney, Agent, or Firm*—John H. Crowe

[57] ABSTRACT

A method of stringing tennis rackets and the resultant racket therefrom in which the string is secured to the racket frame in the form of three isolated sections; a peripheral section, a working main string section and a working cross string section. Each of these sections is formed from a single length of string and is tied off onto itself so that any section can be replaced without disturbing the other two. The peripheral section is made up of three vertical strands at either side of the space within the racket frame, and three horizontal strands at the top and bottom, respectively, of this space. The working main string section is made up of vertical strands occupying the space between the two sides of the peripheral section and the working cross string section is made up of horizontal strands positioned between the horizontal borders of the peripheral section. The area enclosed by the peripheral section generally defines the "sweet spot" of the racket. Because each of the three string sections is tied off onto itself, the racket can be easily repaired by the mere replacement of any section found to be defective. None of the string holes in the racket frame occupied by any of the three string sections is occupied by either of the other two string sections, and this makes it easy to replace any single section without disturbance of the remaining sections.

18 Claims, 5 Drawing Figures

METHOD OF STRINGING RACKETS

This is a continuation, of application Ser. No. 446,780, filed Feb. 28, 1974, now abandoned.

BACKGROUND OF THE INVENTION

This invention relates generally to a method of stringing tennis, and similar, rackets, and more particularly to such a method productive of rackets having superior playing qualities and which can be repaired more quickly and inexpensively than can rackets strung in conventional fashion.

Tennis rackets and rackets of similar character, such as badminton, racket ball and squash rackets, have for years been strung in such a way that damage to the strings can only be repaired by either patching the damaged areas alone or by replacing the strings in their entirety. Patching is often difficult and time-consuming because each job requires its own plan of attack, depending upon knot positions, string patterns, availability of hole space for the accommodation of strings, etc. Patching is particularly difficult in areas near the corners of the racket frame where the string holes in the frame carry multiple strands of string, and where it is occasionally necessary, for that reason, to enlarge with an awl one or more of the clear space areas within a hole or holes to make room for an additional strand, or strands, of the patching string. Consequently, the patching of tennis, and similar, rackets, is a time-consuming chore to the racket stringer for which he is not always well compensated. Moreover, patching often results in a poor quality repair job, for which reason the better players generally prefer to have their rackets completely restrung rather than merely patched. Complete restringing is, however, rather costly, especially where the finer qualities of string are used. This is not difficult to understand when it is appreciated that the average tennis racket requires in the neighborhood of 32 or 33 feet of string, which, when of high quanlity, results in a repair cost of something like $20.00 or $25.00 to the customer.

Tennis, and similar types of, rackets strung in accordance with presently conventional stringing methods have "sweet spot" (efficient hitting) areas of relatively fixed dimensions because of the string patterns used in such methods, regardless of the string tensions employed by the stringers. As those who play tennis, badminton or the like will appreciate, any enlargement of the sweet spot of the playing racket would improve the hitting efficiency, and hence the playing effectiveness, of the racket. No one has heretofore, to my knowledge, however, proposed any way of improving the efficiency of a tennis, or any other stringed, racket by this means.

SUMMARY OF THE INVENTION

I have now provided, in the stringing method of this invention, means for producing tennis rackets and the like which lend themselves to repair techniques of simple and relatively inexpensive character minus the above-noted disadvantages of conventional patching procedures, on the one hand, and the relatively high cost of complete string replacement, on the other. The stringing method of this invention, additionally, it is believed, permits adjustment of the string tensions of rackets in such a way as to cause enlargement of their sweet spot dimensions (over those of conventionally strung rackets) and thereby enhance the playing efficiency or effectiveness thereof.

In stringing a racket by the method of this invention, in its preferred form as presently contemplated, three pieces of racket string of predetermined length are affixed to the racket frame in sequence to form a crossing network of strands in the frame suitably tensioned for effective usage of the racket in the playing of tennis or any other game for which it is intended. One of the three lengths of string is affixed to the racket frame to form a generally rectangular peripheral section (preferably made up of three strands positioned either side, and at the top and bottom, of a central network of string in the finished racket). Another of the lengths of string is secured to the racket frame so as to form a plurality of main strings within the area defined by the peripheral section, the resulting string section being hereinafter referred to as the working main string section. The third length of string is strung on the frame to provide a plurality of cross strings in the space occupied by the working main strings in the area defined by the peripheral section, the resulting string section being hereinafter referred to as the working cross string section. Each of these three sections is tied off onto itself so that the sections are "isolated" from one another to permit the removal of any one for the purpose of racket repair as described below. The working main and working cross string sections are so named because their strands pass through the center area of the racket bounded by the four sides of the peripheral section of strings, which area does most of the ball contacting work (working) when the racket is in play. This center area of the racket is commonly referred to as the "sweet spot" by tennis players.

Since, as indicated above, the three sections of string in rackets strung in accordance with present teachings are isolated (that is, without interconnecting knots), it is a simple matter for a professional stringer to replace any of these sections without disturbing the remaining ones. Thus, the stringer can tailor his repair work to the needs of the individual player who might, for example, as a result of his playing style, wear out one or more sets of working main strings before his working cross strings need replacement, or vice versa. Rackets strung in accordance with the method of this invention can be patched in the same manner as conventionally strung rackets, but the results are no more satisfactory here than in the case of the latter, where, as previously indicated, the patching is often difficult and time-consuming for the stringer and the repair work is frequently of poor quality (because of loose strings or the like). Where the alternative to patching repair of a conventionally strung racket is the replacement of all of its strings, however, the alternative to patching repair of rackets strung in accordance with this invention is generally the replacement of only one, or at the most two, of its three string sections. As will be seen, the three pieces of string from which these sections are formed are of somewhat comparable lengths, which means that the replacement of a single section of string on the racket requires only about a third of the amount of string required to completely restring it. This, of course, reduces the cost, in string, of many repair jobs to about one-third that of a complete restringing job. This is a valid comparison because the replacement of only the defective string section, or sections, of a racket strung in accordance with the method of this invention restores the racket to near top playing efficiency, in contrast to conventional patch work which sometimes, as previously indicated, fails to achieve such a result.

Another advantage of the racket stringing method of this invention over conventional racket stringing methods resides in the fact, indicated above, that it can be practiced in such a way as to enlarge the sweet spot of a racket over the size of the sweet spot of its conventionally strung counterpart. This can be accomplished by stringing the peripheral section at its tension of maximum efficiency, the working main string section at a lower tension than this and the working cross string section at an intermediate tension, so that the peripheral section of the finished racket is more efficient than its working main and cross string sections to, in effect, increase the size of its sweet spot. This is, of course, of great interest to good players since it gives them greater hitting advantage than does a conventionally strung racket with its smaller sweet spot.

It is thus a principal object of the present invention to provide a method of stringing tennis rackets, and the like, capable of producing rackets of high quality and good playing effectiveness that lend themselves to the repair of broken or defective strings by means short of complete restringing, which repairs can be accomplished at a fraction of the cost of such restringing yet are productive of sufficiently good results to restore rackets to very nearly their full playing effectiveness.

Another object of the invention is to provide such a stringing method which can be carried out in a way conducive to enlargement of the sweet spots of stringed rackets over those of their conventionally strung counterparts.

Other objects, features and advantages of the invention will become apparent in the light of subsequent disclosures herein.

DESCRIPTION OF THE PREFERRED EMBODIMENT

Figure 3:
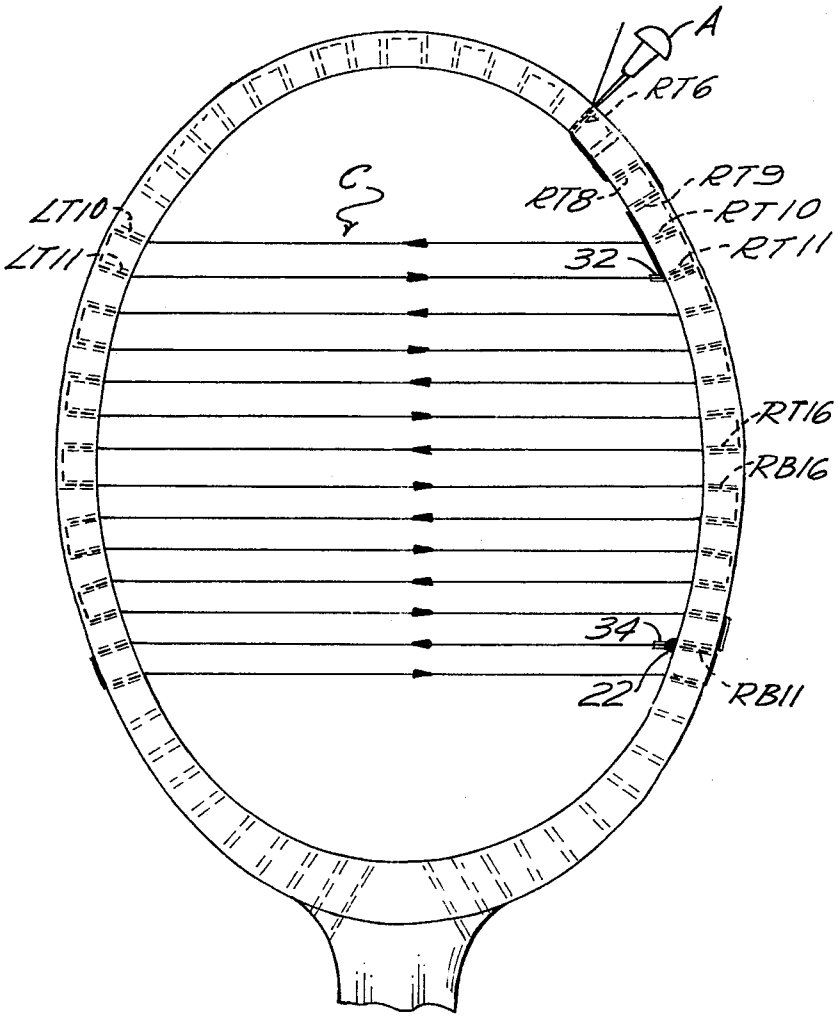
FIG. 3 is still another front view of the tennis racket frame, fitted with a third length of string in such fashion as to illustrate a third, and last, stringing step of said method.
Figure 1:
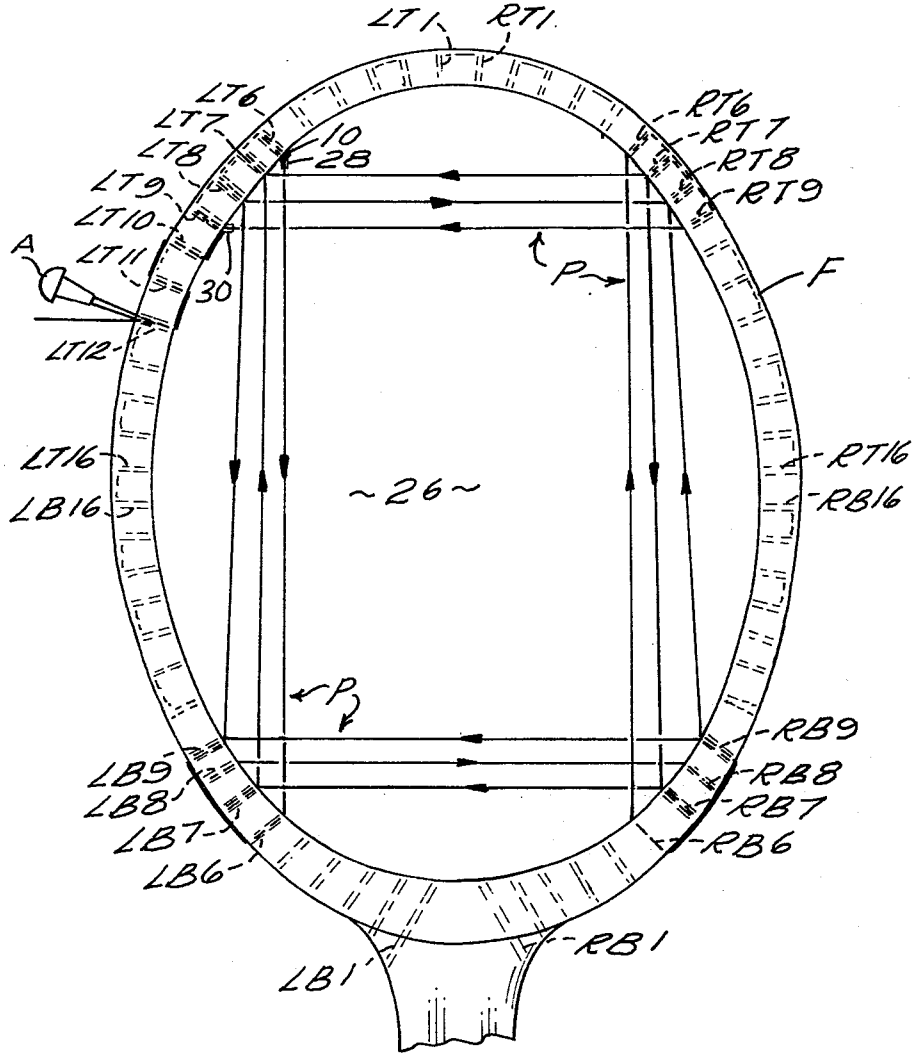
FIG. 1 is a front view of the frame of a wooden tennis racket, partially fitted with a first length of string to illustrate an initial stringing step of a preferred embodiment of the method of this invention.
Figure 2:
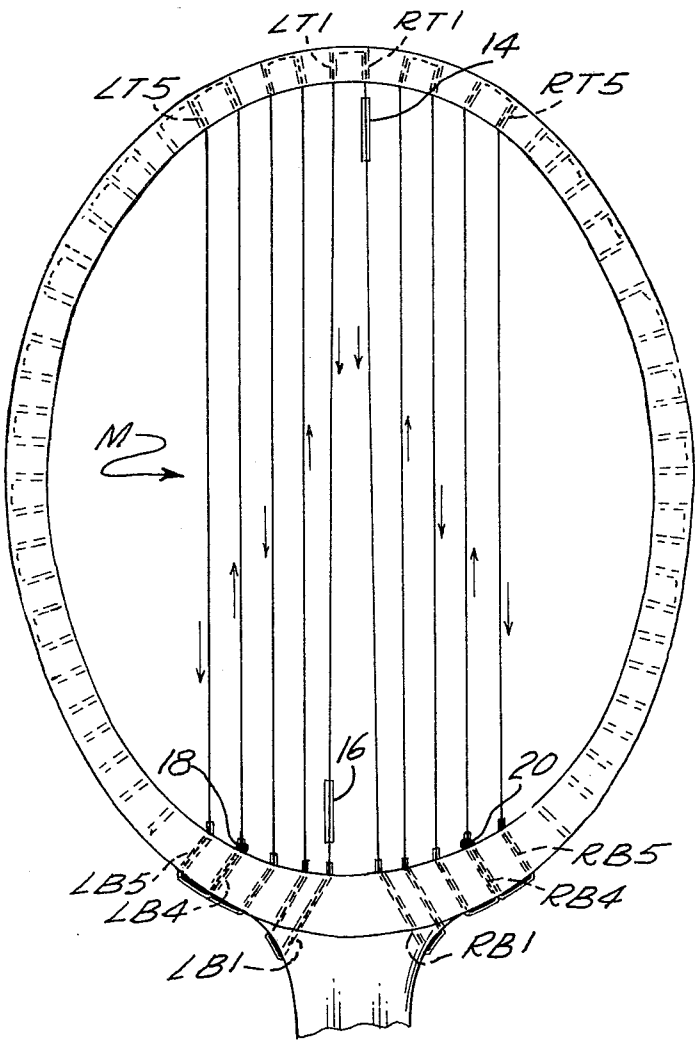
FIG. 2 is another front view of the tennis racket frame, this time partially fitted with a second length of string, to illustrate a second step of the preferred method of the invention.

Considering now the drawings in greater detail, FIG. 1 is a front view of the frame of a fairly typical wooden tennis racket (such as the Dunlop Maxply Fort racket distributed by the Dunlop Sports Division of Dunlop Tire and Rubber Co., of Buffalo, New York) with a peripheral section of string in accordance with this invention attached; FIG. 2 is a similar view of the frame but with a working main string section of string in accordance with the invention attached; and FIG. 3 is another front view of the frame with a working cross string section of string in accordance wth the invention attached. The three sections of string shown in FIGS. 1–3 symbolize three steps comprising a preferred racket stringing method in accordance with the present invention. In the actual practice of this method, the three steps are preferably performed in such sequence that the FIG. 1 peripheral section is first affixed to the racket frame, then the FIG. 2 working main string section and then the FIG. 3 working cross string seation, so that each succeeding section builds up the total string network until, finally, the racket is completely strung and has the appearance illustrated in FIG. 4.

Figure 4:
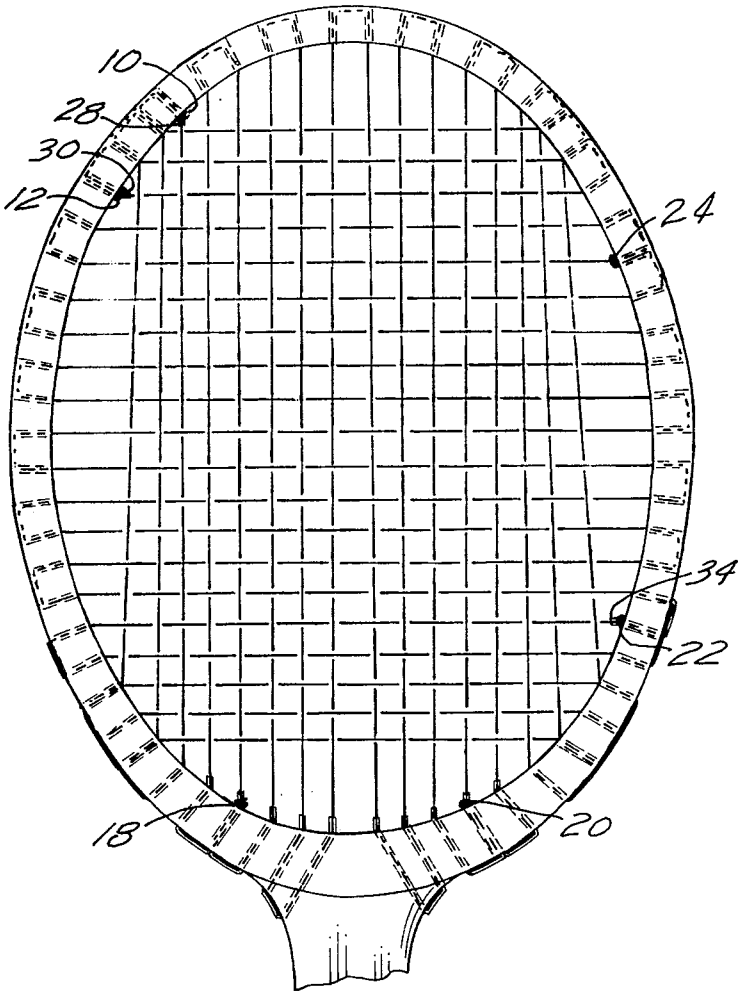
FIG. 4 is a front view of the tennis racket frame fully strung in accordance with said method.

To more clearly demonstrate the aforesaid stringing method, each of FIGS. 2 and 3 shows only the section of string added by a single step of the described method, to the exclusion of any strings added in any previous step, although it will, of course, be understood that the FIG. 2 section of string is, in actual practice, superimposed upon the FIG. 1 section in the second step, and the FIG. 3 section is superimposed upon the FIGS. 1 and 2 sections to complete the stringing of the racket and give it the appearance shown in FIG. 4. The order of stringing steps set forth above is a preferred, but not the only, way of carrying out my novel method, and it can therefore be varied, if desired, within the scope of my invention. As the various sections of the network of racket string are built up, the individual strands are, of course, woven into a fabric of similar structure to that of rackets strung in conventional fashion (see FIGS. 1 and 4 of the drawings or illustrations of this fabric structure).

In FIG. 1 the aforesaid racket frame is shown at F and the completed peripheral section of string at P. That section is strung from a 9½ foot length of suitable string (preferably lamb gut string, although it could be any other type of string available for use in tennis rackets, such as, for example, beef gut, hog gut, nylon, or silk string). As those familiar with the design of tennis rackets are aware, the left and right halves of a typical wooden tennis racket frame, as seen in FIG. 1, have equal numbers of corresponding holes in the frame structure through which the racket string is threaded to permit fastening of the string to the frame. In the FIG. 1 frame (which is, as previously indicated, typical of the vast majority of wooden racket frames) there are sixty-four holes, thirty-two to each side. These holes are spaced around the frame, from points near the center of its top to points near the center of its bottom or throat, sixteen of them occurring in each quadrant. For ease of identification hereinafter, the holes will be identified by quadrant and number, the numbers for each quadrant running in sequence from the top, or bottom, center of the frame, from 1 through 16. For example, the first hole to the left of the top center of the frame will be identified as LT1, the first hole to the right of that center as RT1, the first hole to the left of the bottom center as LB1, and the first hole to the right of that center as RB1. In this numbering system, the lowest hole in the left top (LT) quadrant will be identified as LT16, the lowest hole in the right top quadrant as RT16, the highest hole in the left bottom quadrant as LB16, and the highest hole in the right bottom quadrant as RB16. See FIG. 1, in which the first and last holes of the four quadants are identified in this fashion.

FIG. 1 illustrates one particular way of stringing peripheral section P on frame F which I have found satisfactory for the purpose. In accordance with this method, I first run one end of the 9 ½ foot peripheral section string outwardly through LT8, then inwardly through LT9, outwardly through LT10, inwardly through LT11 and outwardly through LT12. I then awl the string in LT12, as illustrated in FIG. 1, where the awl used for this purpose is shown at A. Next, the string is pulled downwardly from LT8, passed outwardly through LB9, inwardly through LB7, outwardly through LT7, inwardly through LT6, outwardly through LB6, inwardly through LB8, outwardly through RB8, inwardly through RB9, outwardly through LB9, inwardly through LB7, outwardly through RB7, inwardly through RB6, outwardly through RT6, inwardly through RT7, outwardly through RB7, inwardly through RB9, outwardly through RT8, inwardly through RT9, outwardly through LT9, inwardly through LT8, outwardly through RT8, inwardly through RT7, outwardly through LT7, and inwardly through LT6, where it is tied off on a vertical peripheral strand, as illustrated at 10. After tie-off of the string at LT6, it is clamped at LT8 and awled at LT9. The awl at LT12 is then removed and the string is pulled in through LT12, out through LT11, and in through LT10, then tied off at LT9, as shown at 12 in FIG. 4. Peripheral section P is not firmly secured to the racket frame, and the frame is ready to receive the working main string section of FIG. 2. It will, of course, be appreciated by those skilled in the art that the string is pulled under tension, clamped, etc., as necessary during the stringing of the peripheral section to secure that section under proper tension to racket frame F. The same thing will be true of the stringing of the working main and working cross string sections, otherwise discussed hereinafter.

An 11 foot length of string is used to form the working main string section of the racket. This section is shown at M in FIG. 2, and it is formed by running the two halves of the string downwardly through the LT1 and RT1 holes in the racket frame and clamping it at 14 and 16, respectively. The halves of the string are then fed downwardly and upwardly through the holes in the two halves of the racket frame in the manner indicated by the directional arrows in FIG. 2, until holes 1 through 5 at the top and bottom of the frame are all occupied. The string is long enough so that its ends pass downwardly through holes LB5 and RB5 with enough left over, in each instance, to pass inwardly through the LB4 and RB4 holes for the tie-off at LB4 and RB4. See FIG. 4, where the tie-off knots are indicated at 18 and 20, respectively. After completion of the working main string section, the racket is ready to receive the working cross string section in the final step of the stringing process, the latter section being shown at C in FIG. 3. An 11½ foot length of string is used to form the working cross string section, one end being threaded outwardly through RT10, inwardly through RT11, outwardly through RT9, inwardly through RT8 and outwardly through RT6, where it is awled with the awl A, as illustrated. The string is then worked back and forth across the racket frame from RT10 to LT10, LT11 to RT11, etc., down to RB10, where it is passed outwardly, and then inwardly through RB11. The string, now substantially used up, is tied off at RB11, as indicated by the tie-off knot at 22. After it is tied off at RB11, the string is clamped at RT10, then awled at RT11. Awl A is next removed from RT6, and the string is pulled through RT6, RT8, and RT9, after which it is tied off at RT11 (see FIGS. 4 and 5 where the tie-off knot can be seen at 24). The racket is now completely strung, and has the appearance shown in FIG. 4.

Where the racket being strung as illustrated in the accompanying drawings is a Dunlop Maxply Fort racket, the string grooves in the outer rim of its frame will readily accommodate the string patterns of the peripheral and working main string sections P and M, respectively. They will also accommodate the working cross string section C, except for the space between the RT10 and RT11 holes, where a single string groove must be cut for optimum protection of the string against damage should the racket be accidentally dropped or otherwise caused to come into contact with an abrasive pavement, or other, surface. In this case, or any other where a racket's string grooves do not fully satisfy the demands of my novel stringing method, a properly equipped, experienced stringer will have no difficulty in grooving the racket frame as necessary to meet these demands.

As FIG. 1 illustrates, peripheral section P of the string in racket frame F consists of three peripheral main strings at the left, and three at the right, of the space within the racket frame, and three peripheral cross strings at the top and three at the bottom of said space, which cooperate to define a generally rectangular border around a center space 26. Space 26 is, of course, occupied by portions of the working main and working cross strings in the finished racket, and corresponds generally in size and location to the sweet spot of a conventional tennis racket. As previously indicated, however, I can, in effect, enlarge this "sweet spot" by stringing peripheral section P at higher tension than the working main string section, and subsequently stringing the working cross string section at a tension intermediate those of the peripheral and working main string sections. For example, I can string the peripheral section at 65 pounds tension, the working main string section at 50 pounds tension, and the working cross string section at 55 pounds tension. This will have the effect of upgrading the efficiency of the peripheral section, relative to the working main and working cross string sections, thereby bringing enlargement of the aforesaid sweet spot about.

As will now be apparent, my illustrated racket stringing technique results in a racket with three sections of string isolated from one another in the sense that there are no interconnecting knots therebetween so that they are separately removable for repair purposes. Generally, the strings of only one of these sections (typically the working main string section or working cross string section) require replacement before those of the other sections. Where this occurs, the stringer knows exactly what he must do to repair the racket, which is to merely replace the section with the defective strings. He is thus spared the time-consuming necessity of a patch job, and the repaired racket is almost as good as new at roughly one-third the cost, in string, of a substantially equivalently effective repair job on a conventionally strung racket. The string patterns of the peripheral, working main string and working cross string sections of this invention differ from the patterns of more conventionally strung rackets, but much of the actual stringing work is performed similarly to the way conventional stringing is carried out. My techniques differ in several respects from conventional stringing techniques, however, particularly in the awling steps used for starting and winding up the stringing of the peripheral and working cross string sections. The work can be carried out with any of several commercially available stringing machines, the preferred one, however, being the Serrano No-Awl Stringer, manufactured by Tennis Machines Co. of St. Louis, Missouri. Where such a machine is employed for the removal and replacement of the working main strings in a racket strung in accordance with the method of this invention, the racket must be placed in the machine at a 90° angle from its normal position therein to alleviate distortion of the shape of its head due to forces exerted on the head by the working cross strings.

As indicated previously, the novel stringing method of this invention is not limited to use on tennis rackets, but can be employed for use in connection with any similar type of racket requiring strings, such as, for example, a badminton, racket ball, or squash racket. The heart of my invention resides in the concept of stringing such a racket in isolated sections so as to permit the replacement of any section without disturbance of any other one, and thereby render the racket relatively easy to repair for the benefit of sporting goods shops, specialty tennis pro shops and players. I wish to make it clear, however, that the invention is not limited to use of the particular sections illustrated in the drawings, but is sufficiently broad to encompass isolated sections differing in number and shape therefrom. As an example, a method of stringing a tennis racket in two isolated sections, one made up of main strings only and the other of cross strings only, would fall within the broad ambit of my invention, and would therefore constitute a legitimate embodiment thereof.

The method of the present invention is not limited to use in the stringing of wooden rackets, but can be employed for the stringing of rackets of any type, such as, for example, those of steel, aluminum, plastic or any other construction. The pattern of string receiving holes in racket frames, or equivalent means for permitting the attachment of string to rackets, can vary from one brand or type of racket to another. One skilled in the art would, however, with the aid of present teachings, be capable of arriving at suitable patterns for the stringing of isolated sections of string in accordance with this invention in any such frame. The particular patterns illustrated in the drawings are not critical to the wooden frame there shown, and other patterns capable of accomplishing isolated sectional stringing of that frame in line with the principles taught herein can be employed within the scope of the invention.

The tie-offs at the ends of the separate strings of the peripheral, working main and working cross string sections of FIGS. 1–3 can be made with any conventional type of tie-off knot. While I prefer to use two half-hitches for each tie-off knot, any other kind of knot suitable for the purpose can be employed in lieu thereof if desired. In conventional rackets, the tie-off knots are fastened directly to taut strands of string, and this is conducive to excessive wear and strain on, and possible early failure of, the strings at the tie-off points. I have discovered, however, that this difficulty can be substantially overcome by fitting a short (e.g., ⅜ inch) length of plastic (preferably Teflon) tubing around the strand receiving each knot. Four such pieces of plastic tubing can be seen at 28, 30, 32 and 34 on FIGS. 1 and 3, showing the tie-off points for the peripheral and working cross string sections of the illustrated racket. The tubing, of course, serves to cushion the protected string against the squeezing forces of the surrounding knot, and thus prolong the life of that string. The use of suitable plastic tubing in this fashion is not critically necessary to the practice of my invention, however, nor is it, for that matter, limited to such practice, but has applicability in conventional racket stringing methods as well. Large pieces of the Teflon tubing can be used to protect those loops of the working main strings passing through the throat openings in the racket frame against undue wear in the manner indicated in FIG. 2. Where such lengths of tubing are employed at the throat openings of the racket frame, the tie-off knots at the ends of the working main string are fastened around the outer ends of two of the lengths, as illustrated in FIG. 2, where the knots 18 and 20 are shown so fastened. To insure against loosening of the tie-off knots of the string sections, a suitable glue or cement (a clear household cement of any well-known brand being satisfactory for the purpose) can be applied to the knots. This is merely an optional refinement, however, and not a critically necessary part, of the method of this invention.

Figure 5:
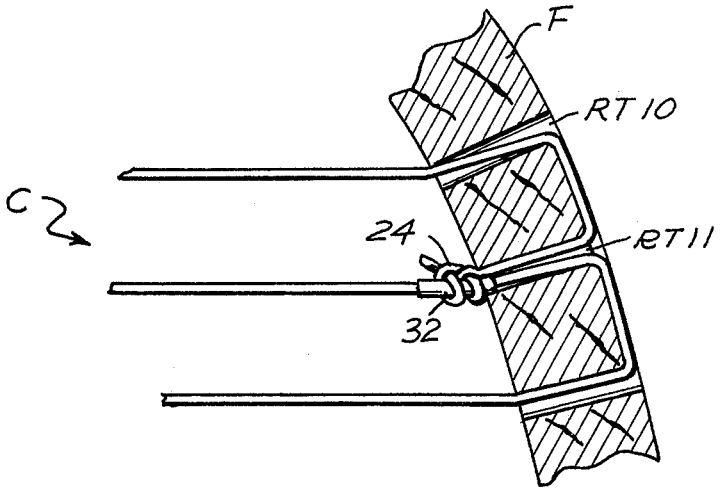
FIG. 5 is an enlarged fragmentary sectional view, showing a portion of the tennis racket frame, parts of said third length of string and a knot by means of which the upper end of the string is tied off onto itself to help hold said string firmly in position in the frame.

As will be evident from the drawings, none of the three string sections in racket frame F shares occupancy of any of the string holes around the frame with any other string section, or, in other words, each string section occupies a separate set of holes. This, coupled with the fact, brought out above, that each of the string sections is tied off onto itself at both ends, makes it possible to replace any of the three sections without disturbing any other section, and thereby constitutes a critically important feature of my invention. The general manner in which each of the string sections is tied off onto itself at each end is illustrated in FIG. 5, which shows an enlarged view of the tie-off knot 24 at the upper end of the working cross string section C (see FIG. 4 for the location of the knot in the racket). As FIG. 5 illustrates, the knot 24 is tied around the second strand from the top of working cross string section C, as seen in FIG. 3, at a point closely adjacent the inner end of the hole RT 11 in frame F (the knot actually, as previously indicated, being tied around a short segment of Teflon tubing 32 surrounding the string at the tie-off point to protect it against undue wear at that location). The knot 24 is a double half-hitch knot, although, as previously indicated, any other suitable type of knot could be employed in lieu thereof if desired. While, as indicated, a suitable cement can be applied to knot 24, no such cement is shown in FIG. 5 since the presence of the cement might tend to obscure certain details of the knot configuration. The working cross string section C, as FIG. 5 clearly shows, extends outwardly through hole RT11 from the knot 24, then inwardly through RT10 to the opposite side of racket frame F where it makes a U-turn through holes LT10 and LT11 (see FIG. 3) and returns to extend outwardly through RT11, from whence it follows the pattern shown in FIG. 3 to completion of that section at knot 22. None of the string holes in the racket frame occupied by the working cross string section C is occupied by either of the other two string sections, and, as indicated, the same thing is true with respect to the latter two sections.

As indicated above, my novel method can be used for the stringing of any type of racket of the class including tennis, badminton, racket ball and squash rackets. There are many and varied rackets within this class, some well-known examples being the steel International Mark 2 tennis racket, the Yvonne Goolagong tennis racket, Power Point squash racket and Maxply Fort badminton racket, all distributed by Dunlop Sports Division of Dunlop Tire & Rubber Corp.; the aluminum Master tennis racket, Arthur Ash Competition tennis racket (of plastic and sheet aluminum construction) and Professional, all manufactured by Head Ski Division of AMF Incorpoated (Boulder, Colorado); the Smasher III (aluminum tennis racket), Pancho Gonzalez Autograph (wood tennis racket), Kro Bat squash racket, and Match Play paddle racquet, all manufactured by Spalding Division of Questor, Chicopee, Mass.; and the Stan Smith Autograph tennis racket (wood), Pro Staff squash racket and Carlton badminton racket (steel) all manufactured or distributed by Wilson Sporting Goods Co. of River Grove, Ill.

While the novel racket stringing method of this invention has been herein illustrated and described in what I consider to be its preferred embodiment, it will be understood by those skilled in the art that various departures may be made therefrom within the scope of the invention. Some of these departures have already been mentioned, and others will occur to those skilled in the art in the light of present teachings. As an example, one such departure would be the formation of a peripheral string section from two or more interconnected strings, rather than the single string of peripheral section P.

In summary, the scope of the present invention extends to all variant forms thereof encompassed by the language of the following claims. As will be seen, these variant forms include rackets strung in accordance with the method of the invention, in addition to the method itself. They also include stringing of the racket so that the successive strings are of gradually increasing tension, from the center strings out, for sweet spot enlargement purposes.

What I claim is:

1. A method of stringing a tennis racket or the like comprising the steps of:

providing a racket frame having a plurality of string holes distributed in a predetermined pattern around its head, a first piece of string of suitable length to form a peripheral section of mesh within the area enclosed by said head, surrounding a central portion of the area, a second length of string of suitable length to form a working main string section consisting of a plurality of main strings passing through said central portion in the longitudinal direction and a third piece of string of suitable length to form a working cross string section consisting of a plurality of cross strings passing through said central portion in the transverse direction;

stringing each piece of string separately through appropriate holes in the head of said racket to form the peripheral, working main string and working cross string sections in said head, said sections being adapted to cooperate to form a complete string mesh for the racket;

the stringing of the three pieces of string including the step of securing each piece near each end in a way to firmly anchor each string section in position in the racket frame under suitable tension for efficient use of the racket; and said stringing being done in such a way that none of the three pieces of string forming the separate sections passes through any string hole occupied by any of the other pieces of string or is secured to any of said other pieces of string, and each section is completely isolated from the other two sections so that no section contacts any other section except within the interwoven mesh portion of the playing area of the racket and can be replaced without disturbance of said other two sections.

2. A method in accordance with claim 1 in which the securing of each of the three pieces of string near each end comprises the tying off of the string near each end to a tightened strand of the string section formed from that piece of string at a point adjacent the inner periphery of said head to form a suitable knot at that point.

3. A method in accordance with claim 2 in which each of the peripheral and working cross string sections is strung by initially threading a first end of the appropriate piece of string outwardly through a first string hole adjacent a second string hole through which will pass the strand around which that piece of string is to be tied near said first end and then inwardly through said second string hole, then interweaving said first end outwardly and inwardly through a plurality of string holes separate from said first and second string holes, then wedging the string in the farthest removed of said plurality of string holes;

stringing the remainder of each of the appropriate pieces of string in their proper patterns in the racket frame head to form a separate one of the aforesaid string sections;

tying the second end of said appropriate piece of string off onto an appropriate strand of the separate string sections;

wedging said appropriate piece of string in said second string hole;

freeing said appropriate piece of string from its wedged confinement in said farthest removed of said plurality of said holes and pulling the freed end back out of said plurality of holes; and tying off said piece of string near said freed end onto said strand adjacent the inner end of said second string hole.

4. A method in accordance with claim 3 in which each of the pieces of string forming said peripheral and working cross string sections is clamped at said first string hole prior to being wedged in said second string hole and tied off onto the strand passing through the latter hole.

5. A method in accordance with claim 4 in which said peripheral section is strung in a pattern comprising three spaced main strings at each side of said area enclosed by said head, three spaced cross strings at the top of said area and three spaced cross strings at the bottom of said area.

6. A method in accordance with claim 5 in which said peripheral section is strung first, said working main string section is strung second, and said working cross string section is strung last.

7. A method in accordance with claim 6 including the step of placing a section of plastic tubing on each strand of said string sections around which a knot is tied during the stringing of said racket, the section of tubing being placed at the knot position prior to the tying of said knot so that the knot subsequently bears on the tubing, whereby said each strand is cushioned against the constrictive cutting force as a result of the presence of said knot at the tie-off point.

8. A tennis racket or the like comprising a racket frame with a head, said frame having three separate pieces of string affixed to its head under tension so as to form a peripheral section surrounding a central portion of the area within the head, a working main string section consisting of a plurality of main strings passing through said central portion in the longitudinal direction and a working cross string section consisting of a plurality of cross strings passing through said central portion in the transverse direction, the piece of string comprising each section being secured at each end in such a way as to maintain that section properly tensioned and positioned for use in the racket frame;

the aforesaid piece of string passing through a separate set of string holes in the racket frame head from any string holes through which the piece of string of either of the other two sections passes so that no string hole is shared by more than one of said pieces of string, the three above-identified sections having no interconnecting means and no section contacting any other section except within the interwoven mesh portion of the playing area of the racket, whereby each section is completely isolated from the other two sections in such fashion that it can be replaced without disturbance of said other two sections.

9. A tennis racket or the like in accordance with claim 8, in which the piece of string comprising each of said sections has each end tied off onto a strand of the section formed thereby adjacent the inner periphery of the head of said racket frame.

10. A tennis racket or the like in accordance with claim 9 including a plurality of sections of suitable plastic tubing respectively positioned around the strands of said sections where the ends of said pieces of string are tied off therearound to cushion said strands against constrictive cutting force as a result of the presence of the knots at the tie-off points.

11. A method of stringing a tennis racket or the like comprising the steps of:

providing a racket frame having a plurality of string holes distributed in a predetermined pattern around its head, a first piece of string of suitable length to form a peripheral section of mesh within the area enclosed by said head, surrounding a central portion of that area, a second length of string of suitable length to form a working main string section consisting of a plurality of main strings passing through said central portion in the longitudinal direction and a third piece of string of suitable length to form a working cross string section consisting of a plurality of cross strings passing through said central portion in the transverse direction; and stringing each piece of string separately through appropriate holes in the head of said racket to form the peripheral, working main string and working cross string sections of said head, said sections being adapted to cooperate to form a complete string mesh for the racket;

the stringing of the three pieces of string including the steps of securing each piece near each end in a way to firmly anchor each string section in position in the racket frame under suitable tension for efficient use of the racket, this being accomplished by tying off each piece of string near each end to a tightened strand of the string section formed from that piece of string at a point adjacent the inner periphery of said head to form a suitable knot at that point.

12. A method in accordance with claim 11 in which each of the peripheral and working cross string sections is strung by initially threading a first end of the appropriate piece of string outwardly through a first string hole adjacent a second string hole through which will pass the strand around which that piece of string is to be tied near said first end and then inwardly through said second string hole, then interweaving said first end outwardly and inwardly through a plurality of string holes separate from said first and second string holes, then wedging the string in the farthest removed of said plurality of string holes;

stringing the remainder of the appropriate piece of string in the proper pattern in the racket frame head to form a separate one of the aforesaid string sections;

tying the second end of said appropriate piece of string off onto an appropriate strand of the separate string section;

wedging said appropriate piece of string in said second string hole;

freeing said appropriate piece of string from its wedged confinement in said farthest removed of said plurality of string holes and pulling the freed end back out of the plurality of holes; and tying off said piece of string near said freed end onto said strand adjacent the inner end of said second string hole.

13. A method in accordance with claim 12 in which each of the pieces of string forming said peripheral and working cross string sections is clamped at said first string hole prior to being wedged in said second string hole and tied off onto the strand passing through the latter hole.

14. A method in accordance with claim 13 in which said peripheral section is strung in a pattern comprising three spaced main strings at each side of said area enclosed by said head, three spaced cross strings at the top of said area and three spaced cross strings at the bottom of said area.

15. A method in accordance with claim 14 in which said peripheral section is strung first, said working main string section is strung second, and said working cross string section is strung last.

16. A method in accordance with claim 15 including the step of placing a section of plastic tubing on each strand of said string sections around which a knot is tied during the stringing of said racket, the section of tubing being placed at the knot position prior to the tying of said knot so that the knot subsequently bears on the tubing, whereby said each strand is cushioned against the constrictive cutting force as a result of the presence of said knot at the tie-off point.

17. A tennis racket or the like comprising a racket frame with a head, said frame having three separate pieces of string affixed to its head under tension so as to form a peripheral section surrounding a central portion of the area within the head, a working main string section consisting of a plurality of main strings passing through said central portion in the longitudinal direction and a working cross string section consisting of a plurality of cross strings passing through said central portion in the transverse direction, the piece of string comprising each section being secured at each end by being tied off onto a strand of the section formed thereby adjacent the inner periphery of the head of said racket frame so as to maintain that section properly tensioned and positioned for use in the racket frame.

18. A tennis racket or the like in accordance with claim 17 including a plurality of sections of suitable plastic tubing respectively positioned around the strands of said section where the ends of said piece of string are tied off therearound to cushion said strands against constrictive cutting force as a result of the presence of the knots at tie-off points.

* * * * *

UNITED STATES PATENT OFFICE

CERTIFICATE OF CORRECTION

Patent No. 4,033,582 Dated July 5, 1977

Inventor(s) GAYLORD C. LINDEN

It is certified that error appears in the above-identified patent and that said Letters Patent are hereby corrected as shown below:

Column 4, line 31, "or" should read --for--.
Column 5, line 26, "not" should read --now--.

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*